United States Patent [19]

Clendinen

[11] Patent Number: 4,646,399

[45] **Date of Patent: * Mar. 3, 1987**

[54] SNAP FASTENER

[75] Inventor: Charles D. Clendinen, Mt. Clemens, Mich.

[73] Assignee: Burton, Parker & Schramm, P.C., Mt. Clemens, Mich.

[ * ] Notice: The portion of the term of this patent subsequent to Mar. 25, 2003 has been disclaimed.

[21] Appl. No.: 832,159

[22] Filed: Feb. 21, 1986

Related U.S. Application Data

[63] Continuation of Ser. No. 522,056, Aug. 10, 1983, Pat. No. 4,577,376, which is a continuation-in-part of Ser. No. 340,204, Jan. 1, 1982, Pat. No. 4,409,706, which is a continuation-in-part of Ser. No. 255,370, Apr. 20, 1981, abandoned, and Ser. No. 340,203, Jan. 1, 1981.

[51] Int. Cl.[4] ..... A44B 17/00

[52] U.S. Cl. ..... 24/624; 24/662; 24/663

[58] Field of Search ..... 24/624, 662, 618, 621, 24/623, 689, 692, 695, 460, 461, 462, 588

[56] References Cited

U.S. PATENT DOCUMENTS

| | | |
|---|---|---|
| 14,581 | 12/1918 | McMeekin . |
| 506,110 | 10/1893 | Hempel . |
| 681,086 | 8/1901 | Washburne . |
| 717,333 | 12/1902 | Brigham . |
| 981,639 | 1/1911 | Hall . |
| 991,156 | 5/1911 | Kerngood . |
| 1,096,897 | 5/1914 | Fisher . |
| 1,187,648 | 6/1916 | Perry . |
| 1,204,173 | 11/1916 | McMeekin . |
| 1,302,918 | 5/1919 | Harris . |
| 1,546,936 | 7/1925 | McCarthy . |
| 1,652,139 | 12/1927 | Elwell . |
| 1,925,053 | 8/1933 | Massino . |
| 2,099,979 | 11/1937 | Bangs . |
| 2,310,249 | 2/1943 | Maskey . |
| 2,328,016 | 8/1943 | Huelster . |
| 2,348,390 | 5/1944 | Kass . |
| 2,397,801 | 4/1946 | Mitchell . |
| 2,483,789 | 10/1949 | Smith et al. . |
| 2,671,355 | 3/1954 | Hawkins . |
| 2,709,290 | 5/1955 | Rosenthal . |
| 2,767,454 | 10/1956 | Johnson . |
| 2,807,069 | 9/1957 | Jansson . |
| 2,895,199 | 7/1959 | Jones . |
| 2,941,270 | 6/1960 | Long . |
| 2,980,975 | 4/1961 | Jones . |
| 2,986,790 | 6/1961 | Silver et al. . |
| 3,107,409 | 10/1963 | Arthaud et al. . |
| 3,210,820 | 10/1965 | Humiston . |
| 3,213,507 | 10/1965 | Christian et al. . |
| 3,328,854 | 7/1967 | Tombari . |
| 3,349,451 | 10/1967 | Maeno . |
| 3,416,200 | 12/1968 | Daddona, Jr. . |
| 3,575,373 | 4/1971 | Reinhardt et al. . |
| 3,729,780 | 5/1973 | White . |
| 3,786,982 | 1/1974 | Rakes et al. . |
| 4,140,163 | 2/1979 | Usner . |
| 4,305,171 | 12/1981 | Pettersson . |
| 4,392,283 | 7/1983 | Timmons . |
| 4,397,061 | 8/1983 | Kanzaka . |
| 4,577,376 | 3/1986 | Clendinen ..... 24/624 |

FOREIGN PATENT DOCUMENTS

| | | |
|---|---|---|
| 91282 | 7/1922 | Austria . |
| 98040 | 4/1897 | Fed. Rep. of Germany . |
| 450924 | 4/1913 | France . |
| 872204 | 6/1942 | France . |
| 80821 | 9/1919 | Switzerland . |
| 453684 | 9/1936 | United Kingdom . |
| 203786 | 6/1942 | United Kingdom . |
| 613038 | 10/1945 | United Kingdom . |

OTHER PUBLICATIONS

IBM Technical Disclosure Bulletin, Jan. 1962.
Forbes Brothers Co. Brochure.
DOT Durable Fasteners Brochure.

*Primary Examiner*—Victor N. Sakran
*Attorney, Agent, or Firm*—Burton, Parker & Schramm

[57] ABSTRACT

A low profile snap fastener comprising a telescoping stud and receiver has latching and locking diameters measured across the stud which are so related to the internal diameter of the receiver that the stud and receiver can only be telescoped to and from a locked position by a predetermined relative motion between them.

10 Claims, 10 Drawing Figures

SNAP FASTENER

RELATED U.S. APPLICATION DATA

This application is a continuation of U.S. application Ser. No. 522,056, filed Aug. 10, 1983, which is now issued as U.S. Pat. No. 4,577,376, which is incorporated by reference herein, which was a continuation-in-part of U.S. application Ser. No. 340,204, filed Jan. 1, 1982, and issued as U.S. Pat. No. 4,409,706 Oct. 18, 1983, which is incorporated by reference herein, which was a continuation-in-part of U.S. application Ser. No. 255,370, filed Apr. 20, 1981, now abandoned, and U.S. application Ser. No. 340,203, filed Jan. 1, 1982.

DESCRIPTION

FIELD OF INVENTION

This invention relates to a snap fastener intended to temporarily connect together a pair of members with which the fastener is associated.

BACKGROUND OF THE INVENTION

There has been a long-felt need for a fastener which overcomes some of the problems associated with the snap button fastener, such as the DOT ® fastener found in service on boat covers and many other canvas and the like articles. Some of the problems associated with the conventional DOT ® type fastener are:

(a) There is a critical tolerance requirement that makes snap buttons unpredictable as to holding strength. Since snap buttons operate by the critical mating of two dimensions, they are subject to great variation in holding strength because of variations in dimensions or tolerances in the spring ring and male stud parts. Because most snap button fasteners are sheet brass made on progressive dies, they are soft enough to be deformed during usage and this can render them inoperable or change their holding characteristics, making them either too loose or too tight.

(b) Weathering of the parts of snap button fasteners can make the buttons too tight to pull apart, especially in hostile environments like salt water, industrial pollution and the like.

(c) Limited strength due to manufacture from sheet brass or molded plastic construction renders the conventional snap button fastener of limited utility when confronting heavy loads.

(d) There is considerable difficulty in operating such a fastener when either the male or female side of the fastener is covered with foreign matter such as dust, mud, ice, grease, etc.

In the prior art the following patents depict fastening devices in which a stud and/or eyelet must be deformed as a necessary condition precedent to latching or locking the stud and eyelet together: U.S. Pat. Nos. 991,156; 2,397,801, 2,986,790; 3,213,507; 3,349,451; 3,416,200; 3,729,780 and 2,786,982.

SUMMARY OF THE INVENTION

I have discovered that a low profile snap fastener may be provided in which the receiver member which is telescoped over the stud may lie in a position parallel to the member upon which the stud is mounted, or, in other words, perpendicular to the axis of the stud, rather than being askew thereof as in the case of the fasteners shown in the aforesaid related applications. In carrying out the invention, the stud is provided with receiver seats on opposite sides thereof with a latching shoulder on the stud above one of the seats and a retaining lobe on the stud above the other seat. The receiver has an internal diameter allowing it to be telescoped over the stud for nesting in the seats. The internal diameter of the receiver is sufficiently less than the diameter of the stud measured from the apex of the aforesaid lobe to the seat on the opposite side of the stud, that the receiver cannot bypass the lobe when it is nested in such seat at the opposite side of the stud. At the same time, the internal diameter of the receiver is slightly less than the diameter of the stud as measured from the apex of the latching shoulder to the seat on the opposite side of the stud by an interference amount in which the stud and/or receiver may be deformed within the elastic limit to allow the receiver to snap past the latching shoulder while nested in such seat at the opposite side of the stud.

Other features and advantages will become apparent during the following description.

DETAILED DESCRIPTION OF PREFERRED EMBODIMENT

Figure 3:
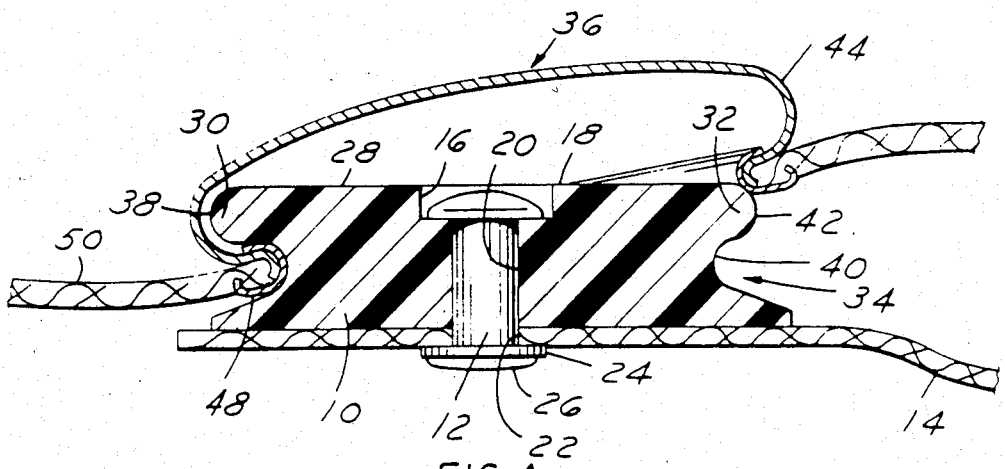
FIG. 3 shows the receiver nested in the receiver seat beneath the retaining lobe about to be snapped past the latching shoulder.

In FIG. 3 I have shown a stud 10 of generally cylindrical configuration and a relatively low profile secured as by a rivet 12 to a part or member to be secured by the fastener, such as a fabric or the like 14. The head of the rivet is received in a counterbore 16 in the upper end 18 of the stud and extends through a bore 20, through a provided aperture 22 in the fabric 14, through a washer or the like 24 and is headed as at 26 below the washer. The stud may also be secured to the fabric 14 in any other suitable fashion and the arrangement shown is merely intended to show a means of securement.

The stud 10 may be formed of plastic or may be a cold headed part or may be formed on a progressive die. The stud includes a head portion 28 which in the embodiment shown is concentric with the bore 20 and is of uniform cross-section circumferentially of the stud. The head 28 defines what may be referred to as a retaining lobe 30 and a latching shoulder 32 which are on opposite sides of the stud and in this embodiment are simply portions of the uniform head portion 28. The retaining lobe and latching shoulder in some embodiments may be of different configurations to suit the latching action desired.

Figure 2:
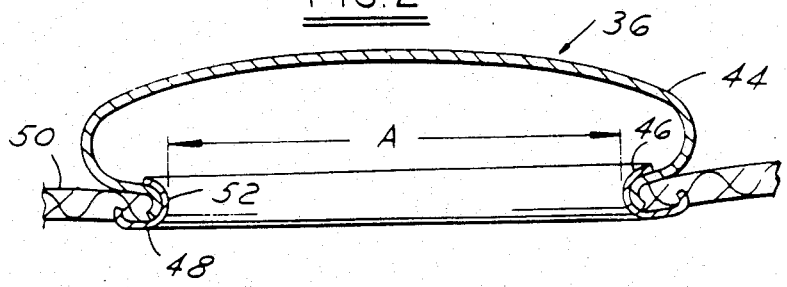
FIG. 2 is a cross-sectional view through a receiver usable with the stud.
Figure 4:
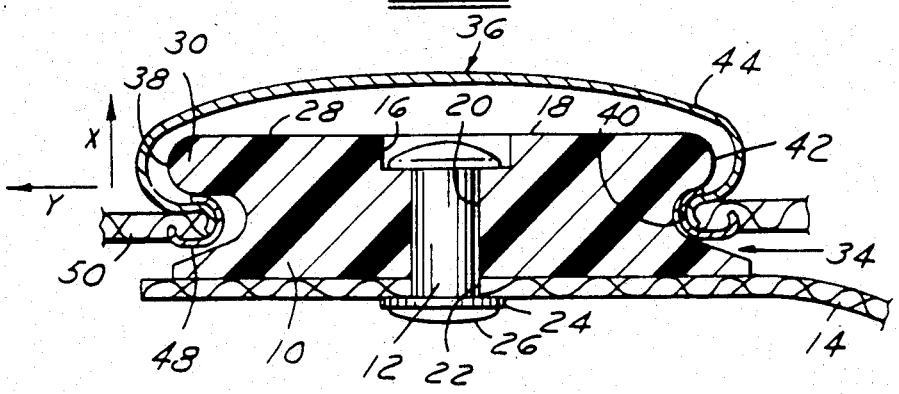
FIG. 4 shows the receiver in latched position on the stud.
Figure 5:
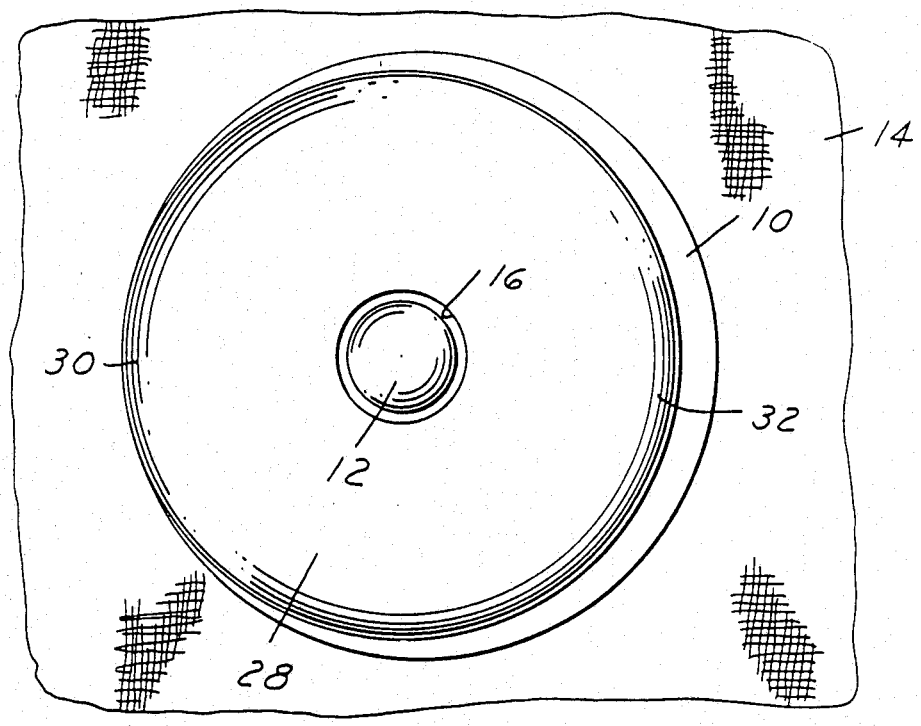
FIG. 5 shows the stud secured to a section of fabric.
Figure 6:
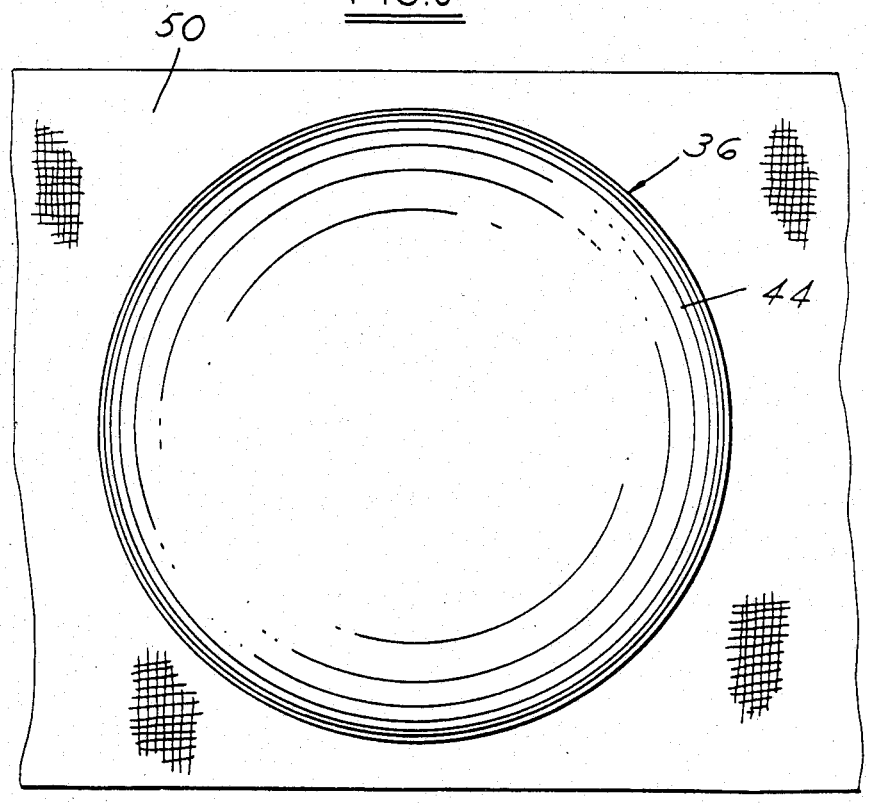
FIG. 6 shows the receiver secured to a section of fabric.

Beneath the head portion 28 there is a circumferential groove 34 which provides a receiver seat immediately below each of the lobe and latching shoulder so that the receiver 36 shown in FIG. 2 may be nested in such groove as hereinafter explained and as shown in FIG. 4.

Figure 1:
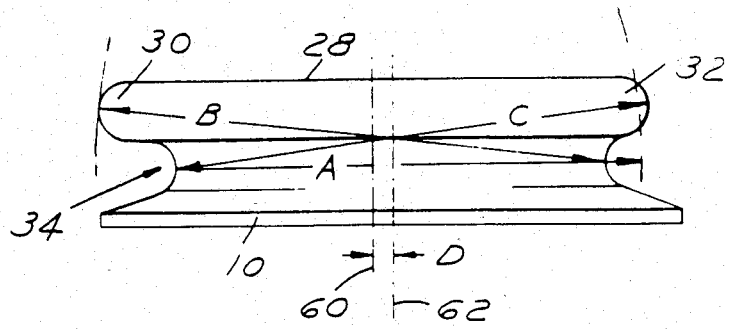
FIG. 1 is a side elevation of a stud illustrating certain critical relationships in the configuration thereof.

The stud lobe 30 has an apex 38 between which and the bottom 40 of groove 34 on the opposite side of the stud defines a diameter B shown in FIG. 1, which may be referred to as the "locking diameter". The latching shoulder has an apex 42 between which and the bottom 40 of groove 34 at the opposite side of the stud, defines what may be referred to as a "latching diameter" shown in FIG. 1 at C.

The receiver 36 may take various forms. In the drawings the receiver is a cylindrical hat-shaped button having a dome portion 44 which has been crimped within a separate rim portion 46, both the dome and rim portions having been crimped around the marginal edge 48 of an aperture in a fabric member 50 in which the receiver or button is mounted. Except for the dome portion 44, the in FIG. 2. In FIG. 1 the diameter A of the receiver is shown superimposed upon the stud. From FIG. 1 it will be noted that dimension A measured from the bottom of the groove 34 beneath the locking lobe 30 is slightly less than dimension C. The difference in dimensions A and C provides an interference fit between the receiver and stud wherein either the receiver or stud or both may deform within the elastic limits of such parts to allow the receiver to pass from the position shown in FIG. 3 to that shown in FIG. 4 wherein the internal rim 46 of the receiver will snap past the apex 42 of the latching shoulder 32 to be seated in the groove or receiver seat 34 therebeneath.

Dimension B shown in FIG. 1 and referred to as the "locking diameter" is greater than the receiver diameter A by an amount preventing the receiver from being removed over the lobe 30 when the receiver is seated at its opposite side in the receiver seat beneath the latching shoulder 32. In other words, when the receiver is mounted on the stud as shown in FIG. 4, the receiver cannot be forced, without destruction, off the stud by pulling the fabric 50 in the directions of either X or Y as shown in FIG. 4. The receiver, however, can easily be removed from the stud by pulling the fabric 50 in the opposite direction of arrow Y causing the receiver to seat beneath lobe 30, and then rotating the receiver up, snapping past latching shoulder 32 as shown in FIG. 3.

As shown in FIG. 1, the head portion 28 is formed on the axis 60. The groove 34 defining the receiver seats is formed on the axis 62 which is displaced from the axis 60 by the dimension D. Such displacement of the respective axes gives rise to the locking and latching diameters B and C respectively and enables securement of the receiver on the stud. In the embodiment shown, the axes 60 and 62 are parallel and their displacement D is substantially equal to the difference in the locking and latching dimensions B and C respectively.

Figure 7:
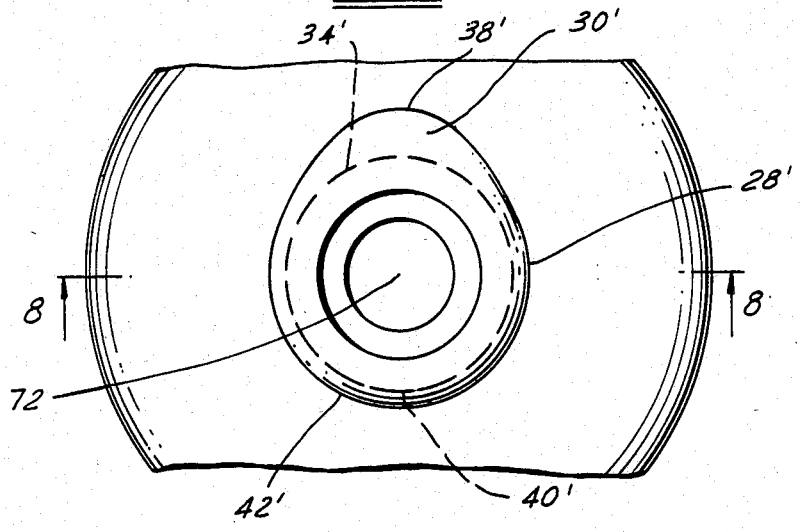
FIG. 7 is a fragmentary plan view of a modified form of the stud.
Figure 8:
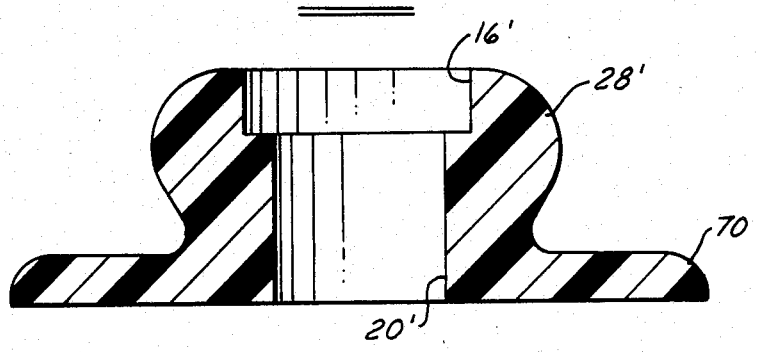
FIG. 8 is a cross-sectional view taken on the line 8—8 of FIG. 7.

A modified form of the stud is shown in FIGS. 7 and 8. Similar but primed reference numerals indicate parts generally corresponding to those previously described. Stud bead 28 is generally pearshaped in plan view as best shown in FIG. 7. Instead of having radially displaced axes 60 and 62 as in FIG. 1, in this modified form there is a lobe 30' which extends radially farther from the stud axis 72 than the remaining portions of the stud. The transverse dimension measured from the apex 38' of the lobe 30' to the seat 40', and which corresponds to dimension B of FIG. 1, is sufficiently greater than the internal diameter A of the receiver shown in FIG. 2 or diameter A' of the receiver shown in FIG. 9, that once either receiver is mounted on the stud of FIGS. 7 and 8, they cannot be removed by trying to lift them off the stud by first by-passing apex 38' of lobe 30'. At the same time, the transverse dimension of the stud measured from the latching shoulder 42' to the seat 34' of the groove beneath the head is only very slightly greater than the diameter A or A' to provide an interference fit so that similar to FIG. 3, he receiver may be snapped on and off the stud.

The stud may be provided with a central aperture 20' and have an upwardly opening counterbore 16' to facilitate securement to one of the parts to be joined. The stud may be provided with a base portion 70. Any suitable fastener may be extended through the aperture 20' to secure the stud to a part to be fastened.

Figure 9:
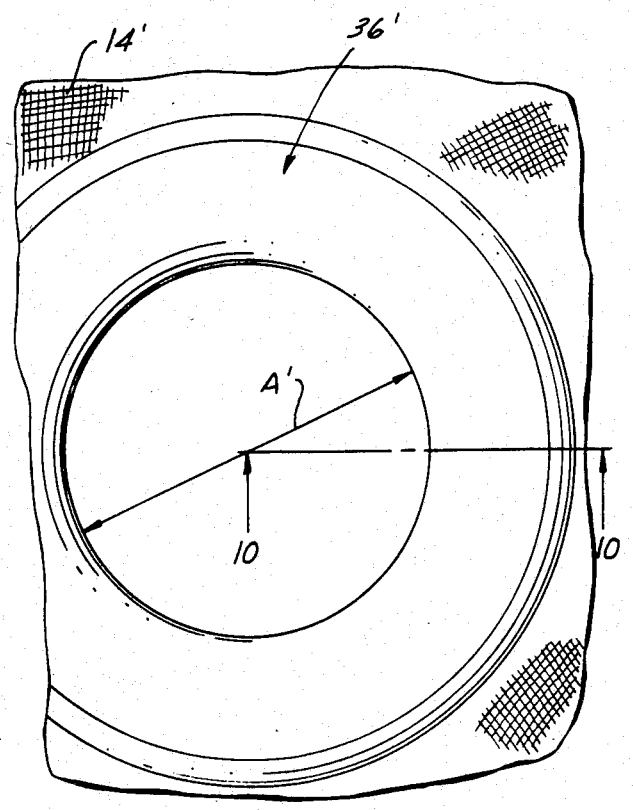
FIG. 9 is a fragmentary plan view of a modified form of the receiver.
Figure 10:
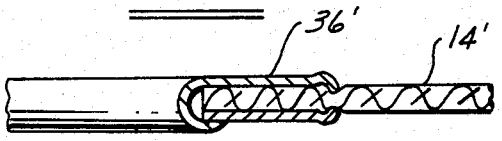
FIG. 10 is a cross-sectional view taken on the line 10—10 of FIG. 9.

The receiver 36' shown in FIGS. 9 and 10 may be in the form of a conventional grommet crimped over the marginal edge of a hole in the fabric 14'. The internal diameter A' of the grommet is preferably sized during crimping on the fabric to fulfill the dimensional requirements for operability as mentioned above.

It will also be understood, of course, that while the form of the invention herein shown and described constitutes a preferred embodiment of the invention, it is not intended to illustrate all possible forms thereof, It will also be understood that the words used are words of description rather than limitation and various changes may be made without departing from the spirit and scope of the invention disclosed.

I claim:

1. A snap fastener comprising, in combination:

a stud intended to upstand at one end from a member to be fastened;

receiver seats disposed on opposite sides of the stud;

a latching shoulder on the stud above one of the seats;

a retaining lobe on the stud above the other seat;

said latching shoulder and retaining lobe having a continuous peripheral surface defining a pear-shaped stud head;

a receiver intended for association with a member to be fastened to the first mentioned member and having an aperture with a continuous internal surface dimensioned to allow telescoping over the stud for nesting in said seats;

said internal dimension of the receiver being sufficiently less than the dimension of the stud measured from the apex of said lobe to the seat on the opposite side of the stud, that the receiver cannot bypass the lobe when nested in such seat at the opposite side of the stud; and said internal dimension of the receiver being such in relation to the dimension of the stud, measured from the apex of said shoulder to the seat on the opposite side of the stud, to provide an interference fit permitting the receiver to pass the shoulder while nested in such seat at the opposite side of the stud and upon the elastic deformation of the stud and/or receiver.

2. The invention defined by claim 1 wherein said latching shoulder and retaining lobe comprise portions of the stud head at opposite sides of the stud.

3. The invention defined by claim 1 wherein the receiver seats comprise portions of the groove at opposite sides of the stud, which groove extends circumaxially around the stud at a substantially uniform distance from a determined axis.

4. The invention defined by claim 1 wherein the stud is formed of plastic.

5. The invention defined by claim 1 in which the stud has a generally cylindrical configuration except for said pearshaped head.

6. The invention defined by claim 5 wherein the aperture in the receiver is circular and has an internal diameter sized to provide an interference fit as the receiver telescopes over the stud.

7. The invention defined by claim 6 wherein means are provided disposed coaxially of the stud for facilitating securement thereof to the member to be fastened.

8. A stud for a snap fastener comprising a generally cylindrical member having a head at one end and intended to be mounted in upstanding relation at its opposite end on a member to be fastened;

receiver seats disposed on opposite sides of the stud beneath said head;

a latching shoulder on the head above one of the seats;

a retaining lobe on the head above the opposite seat;

said stud, including the latching shoulder and retaining lobe having a continuous peripheral surface and being generally pearshaped;

the dimension of the stud measured from the apex of said lobe to the seat on the opposite side of the stud being greater than the dimension of the stud measured from the apex of said shoulder to the seat on the other side of the stud to lock a receiver in said seats beneath the head.

9. The invention defined by claim 8 wherein the stud is formed of plastic.

10. The invention defined by claim 8 wherein means are provided disposed coaxially of the stud for facilitating securement thereof to the member to be fastened.

* * * * *